US008747708B2

(12) United States Patent
Rueger et al.

(10) Patent No.: US 8,747,708 B2
(45) Date of Patent: Jun. 10, 2014

(54) ELECTRICALLY CONDUCTIVE FLOOR CARE COMPOSITIONS

(75) Inventors: Reinhold Rueger, Roedemark (DE); Matthias Kuntz, Seeheim-Jugenheim (DE); Christina Maggakis-Kelemen, Moenchengladbach (DE)

(73) Assignee: Merck Patent GmbH, Darmstadt (DE)

( * ) Notice: Subject to any disclaimer, the term of this patent is extended or adjusted under 35 U.S.C. 154(b) by 281 days.

(21) Appl. No.: 13/052,264

(22) Filed: Mar. 21, 2011

(65) Prior Publication Data

US 2011/0227005 A1 Sep. 22, 2011

(30) Foreign Application Priority Data

Mar. 19, 2010 (DE) ..... 10 2010 012 197

(51) Int. Cl.
*H01B 1/08* (2006.01)
*B05D 5/12* (2006.01)

(52) U.S. Cl.
USPC ..... 252/519.51; 252/520.1; 427/126.3; 510/109

(58) Field of Classification Search
USPC ..... 252/518.1, 519.51, 520.1, 520.2; 427/126.3; 510/109
See application file for complete search history.

(56) References Cited

U.S. PATENT DOCUMENTS

| | | | | |
|---|---|---|---|---|
| 5,425,995 | A * | 6/1995 | Unruh | 428/461 |
| 6,162,374 | A * | 12/2000 | Schoen et al. | 252/511 |
| 6,632,276 | B1 * | 10/2003 | Vogt | 106/417 |
| 6,921,788 | B1 * | 7/2005 | Izawa et al. | 524/430 |
| 7,416,688 | B2 * | 8/2008 | Pfaff et al. | 252/518.1 |

* cited by examiner

*Primary Examiner* — Mark Kopec
(74) *Attorney, Agent, or Firm* — Millen, White, Zelano & Branigan, P.C.

(57) ABSTRACT

The present invention relates to a transparent, electrically conductive floor care composition, in particular for antistatic flooring, which is distinguished by the fact that it comprises one or more conductive pigments.

13 Claims, 3 Drawing Sheets

Surface resistance of various self-shining dispersions for floorcoverings having particular requirements of the electrical behaviour for two different atmospheric humidities (RH)

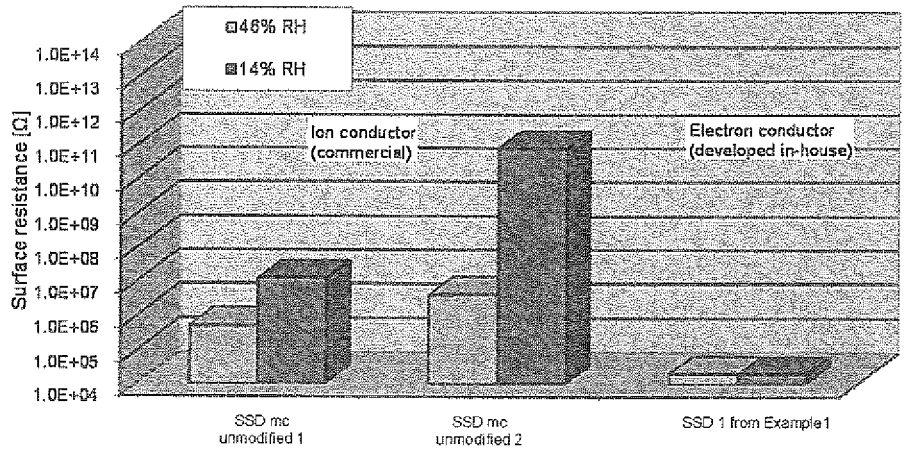
Figure 1: Surface resistance of various self-shining dispersions for floorcoverings having particular requirements of the electrical behaviour for two different atmospheric humidities (RH)
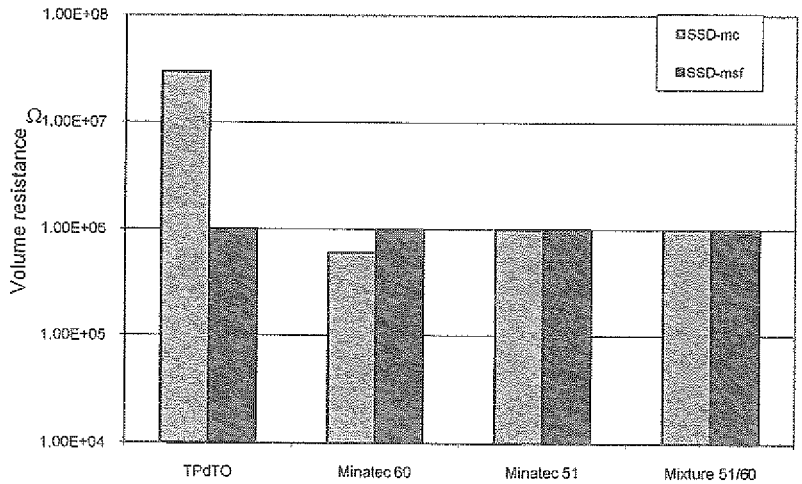
Figure 2: Volume resistance of various self-shining dispersions (metal salt-free and metal-crosslinked) comprising conductive pigments on conductive PVC

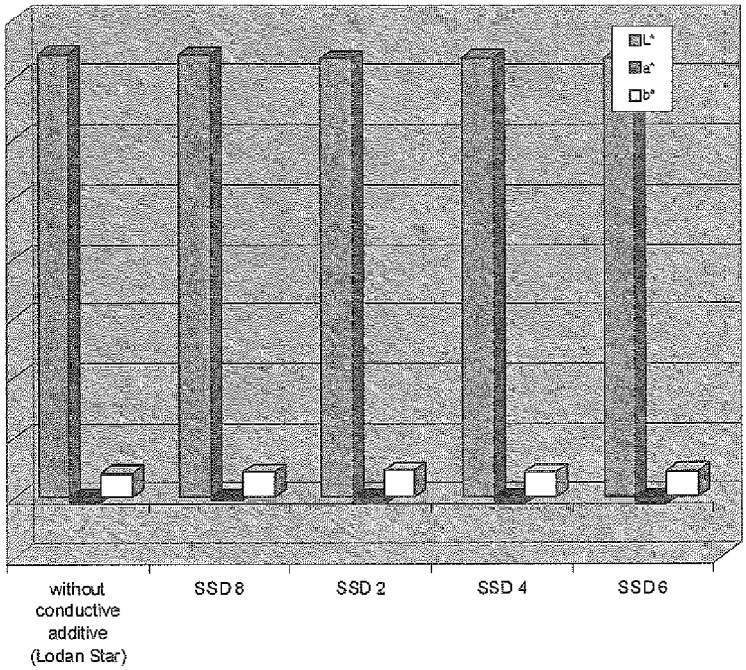
Figure 3: Colour measurement of the modified metal-crosslinked care film (SSD-mc and SSD-msf in accordance with Example 1) on rubber with different conductive pigments
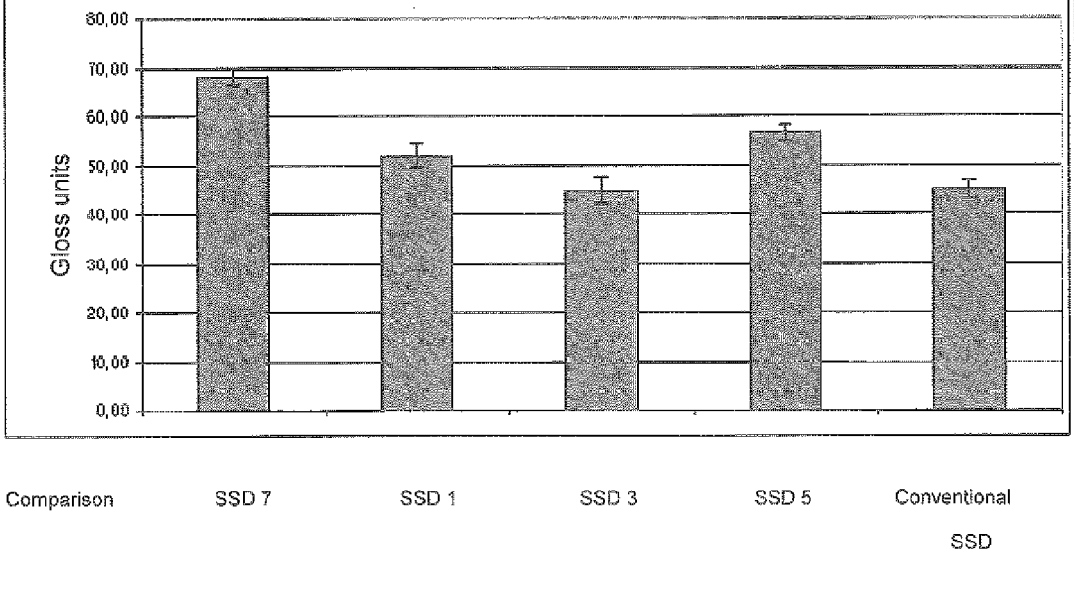
Figure 4: Gloss measurement of the modified metal-crosslinked or metal salt-free care film on rubber with different conductive pigments

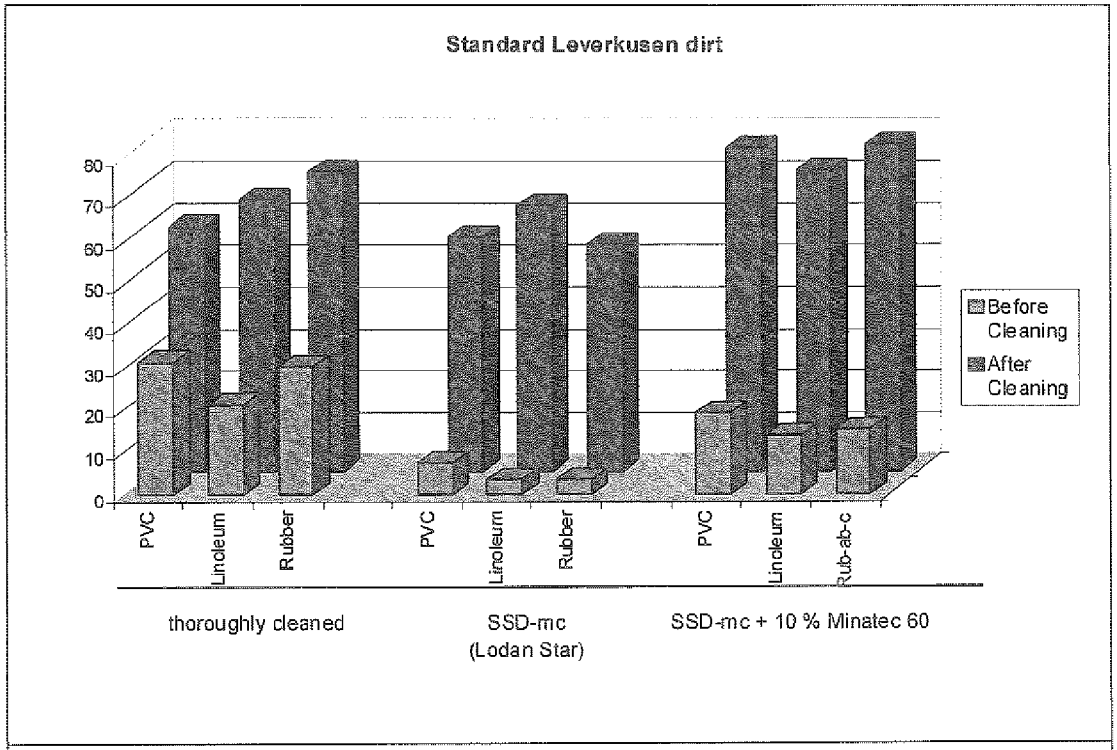
Figure 5: Soiling behaviour and cleaning intensity of various floorcoverings (thoroughly cleaned or with commercially available and modified care film)

ELECTRICALLY CONDUCTIVE FLOOR CARE COMPOSITIONS

The present invention relates to a transparent, electrically conductive floor care composition, in particular for antistatic flooring, which is distinguished by the fact that it comprises one or more transparent, electrically conductive pigments.

In sensitive working areas (for example electronics industry, data processing, laboratories, clean rooms, hospitals, chemical plants or other plants with a risk of explosion), electrostatic discharges have to be prevented. Sensitive working areas of this type are often referred to as EPAs. EPA stands for "electrostatic-protected area". In the electronics industry, sensitive electronic components are produced in EPAs or installed in other assemblies, so-called ESDs (electronic sensitive devices). The latter may also be the case, for example, in automobile manufacture or aircraft construction, which is why EPAs are also necessary in other industries. An EPA can be, for example, a bench, a marked area in a room, a laboratory or a factory shed.

In order to prevent electrical discharges, electrostatic discharge floorcoverings (ESD floors) are employed in areas of this type. High demands are made of the electrical properties for these floorcoverings. They must have surface resistance values of less than $10^8$ ohm and low volume resistance values in order reliably to suppress electrostatic discharges when walked on. The antistatic properties must be guaranteed throughout the lifetime of the floorcoverings and floor coatings.

The requirements of ESD floors are stipulated, inter alia, in the standards DIN EN 61340-4-1 and DIN EN 61340-5-1.

For aesthetic and hygienic reasons, the floorcoverings and floor coatings employed require regular cleaning and care in order to retain their functional properties and in order to prevent premature wear.

However, the cleaning and care must not significantly impair the surface conductivity and discharge capacity of the floorcoverings, otherwise they lose their antistatic properties and the room is no longer safe to use.

In particular, cleaning and care compositions which change the resistance to earth RE of the flooring in an impermissible manner must not be employed.

The cleaning effort required for antistatic flooring is considerably greater than in the case of conventional floorcoverings, since the application of care films in order to reduce cleaning effort and wear is not possible. The reason is that the care methods currently available result in a considerable increase in the resistance values and thus in an impairment of the antistatic properties of the flooring owing to the insulating properties of the care compositions applied. As a consequence, the ability of the flooring to function is no longer guaranteed.

Electrically conductive pigments are employed in various areas of application today, for example for antistatic coatings, antistatic floorcoverings, antistatic treatment of explosion-protected rooms or electrically conductive primers for the painting of plastics. Carbon black or graphite is usually employed in order to increase the conductivity of the materials. A possible solution to the cleaning problem described above could thus consist in adding carbon black or graphite as conductive filler to the floor care compositions. However, these substances have the disadvantage of not being transparent and thus always resulting in a darkening of the materials to which they have been added. This solution approach is therefore restricted to dark to black flooring and is not practical owing to this restriction.

In order to obtain pale and transparent antistatic care films on the flooring, conductive salts, preferably in the form of organic salts, for example alkyl- or arylammonium compounds or sulfonates, are also added to the care compositions. Although these give colorless and transparent care films, they have, however, the disadvantage of only exhibiting adequate electrical conductivity in the presence of moisture and of the antistatic action failing in the case of dry room air. In addition, salt-like systems have the disadvantage that the salts are dissolved out of the coating with the wiping water and the antistatic effect thus disappears entirely.

There is to date no practicable solution to the problem of the care of electrostatic discharge floorcoverings.

An object of the present invention is therefore to provide a care and cleaning composition which forms very pale and transparent care films which do not impair the antistatic properties of the floorcoverings, or only do so to an insignificant extent, and at the same time simplifies the cleaning of the flooring and reduces wear.

Surprisingly, it has now been found that care films for flooring which comprise at least one transparent, electrically conductive pigment effectively achieve the object set above on an antistatic or static dissipation floorcovering.

The invention therefore relates to a floor care and cleaning composition, preferably for antistatic flooring, which comprises at least one transparent, electrically conductive pigment.

The care compositions according to the invention are distinguished by the fact that, after application to the floorcovering in the form of care films, they exhibit high conductivity
little color change
little drop in sheen
no effect on roughness
lower soiling behavior
little change in sheen and color due to ageing
no or little change in viscosity.

Floor care compositions are defined as cleaning compositions and care compositions for the maintenance and cleaning of hard floors with coverings comprising ceramic, stone, wood, linoleum, cork, PVC, rubber, laminate, inter alia. The flooring is treated with special care emulsions for protection against soiling and damage, including wear.

The floor care compositions are generally commercially available as emulsions or dispersions and as oil-based products in liquid or paste form. The liquid phase used is water or a solvent or solvent mixture. Self-shining care compositions are water-based products which exhibit a sheen without polishing after application. These are distinguished from self-shining care compositions having a cleaning action (so-called wipe-on care compositions). The compositions are generally used as concentrates for the formation of a resistant care layer or in aqueous dilutions for continuous cleaning and care. The main constituent is polymeric film formers, such as, for example, acrylates, waxes (natural waxes, paraffins, polyethylenes, microwaxes, montan wax derivatives). These constituents are introduced into the liquid phase by emulsifiers. In addition, the care compositions having a cleaning action comprise surfactants.

These floor coating compositions, which generally comprise wax and/or film-forming polymers in varying composition, form continuous films, which have a dirt-repellent action, on the flooring after drying. Films which have a high wax content can additionally easily be polished and can also easily be removed again from the surfaces if required, while films which consist predominantly or completely of film-forming polymers are particularly resistant to mechanical stress.

The care film comprising electrically conductive pigments is obtained by application of the care composition to the floorcovering by standard methods, for example by wiping.

Owing to the advantageous geometry and the resultant particular suitability for the formation of pathways in very thin care films, particular preference is given to thin, transparent, flake-form conductive pigments.

Suitable electrically conductive pigments are based on flake-form substrates which are coated with a conductive layer. Suitable flake-form substrates are all flake-form substrates known to the person skilled in the art, such as, for example, phyllosilicates, in particular synthetic or natural mica flakes, glass flakes, $SiO_2$ flakes, $TiO_2$ flakes, $Al_2O_3$ flakes, sericite, kaolin, talc or mixtures thereof. The flake-form substrates are preferably natural or synthetic mica flakes, $SiO_2$ flakes or glass flakes.

The size of the base substrates is not crucial per se and can be matched to the respective application. In general, the flake-form substrates have a thickness of between 0.02 and 5 μm, in particular between 0.05 and 4.5 μm. The size in the two other dimensions is usually between 1 and 250 μm, preferably between 2 and 200 μm and in particular between 5 and 150 μm. Glass flakes preferably have a layer thickness of ≤1.0 μm, in particular ≤0.8 μm and very particularly preferably ≤0.5 μm.

The electrically conductive layer generally comprises a doped metal oxide or a doped metal-oxide mixture. The metal oxide is preferably tin oxide, zinc oxide, indium oxide, titanium dioxides or mixtures thereof. The said metal oxides are in doped form in the conductive layer, where the doping can be carried out with gallium, aluminium, indium, thallium, germanium, tin, phosphorus, arsenic, antimony, selenium, tellurium, tungsten and/or fluorine. The metal-oxide layer here may comprise one dopant or a mixture of various dopants. Preferred dopants, alone or in combination, are aluminium, indium, tellurium, fluorine, tungsten, phosphorus, antimony, very particularly preferably antimony.

In a particularly preferred embodiment, the conductive layer employed is antimony-doped tin oxide, antimony- and tellurium-doped tin oxide, tin-doped indium oxide, aluminium-doped zinc oxide, or fluorine-doped tin oxide, tungsten-doped tin oxide, tungsten- and phosphorus-doped tin oxides, or indium-doped zinc stannate. Particular preference is given to a conductive layer consisting of antimony-doped tin oxide. The tin to antimony weight ratio in this preferred embodiment is preferably 4:1 to 100:1, in particular 7:1 to 50:1.

The proportion of the conductive layer, based on the flake-form substrate, is preferably 25-120% by weight, preferably 50-75% by weight.

The proportion of the dopant or dopant mixture in the conductive layer is preferably 0.1-30% by weight, in particular 2-15% by weight.

Electrically conductive pigments based on natural or synthetic mica flakes are described in the patent literature, for example in DE 38 42 330, IDE 42 37 990, EP 0 139 557, EP 0 359 569, EP 0 743 654, DE 10 2005 018 615 A1. These pigments consist of mica, optionally coated with a metal-oxide layer, preferably a $TiO_2$ coating, which are covered with an antimony-doped tin-oxide layer [$(Sn,Sb)O_2$]. Pigments of this type are commercially available, for example, under the trade name Minatec® from Merck KGaA.

Preference is furthermore given to conductive pigments which consist of 5-95% by weight, preferably 20-80% by weight, of a component A, which consists of one or more conductive, flake-form pigments, and 5-95% by weight, preferably 20-80% by weight, of a component B, which consists of one or more conductive, non-flake-form pigments, for example quartz flour or spherical $SiO_2$ particles. Conductive pigments of this type are known, for example, from DE 42 12 950 B4.

The flake-form pigments of component A include on the one hand pigments comprising flake-form support materials, such as, for example, natural or synthetic mica, kaolin, talc, and on the other hand may be support-free pigments, which are prepared, for example, on a continuous belt.

Non-flake-form pigments of component B which may be mentioned are, in particular, spherical particles. These pigments are either support-free or the conductive layer is applied to a support, for example a hollow or solid sphere. Support materials which can be used are also finely ground mica, kaolin or talc which no longer have a flake structure. Particular preference is given to $SiO_2$ spheres (amorphous) coated with a conductive layer. A further suitable substrate is quartz flour, which is in the form of irregularly shaped spheres. The quartz flour (crystalline $SiO_2$) can be prepared, for example, by finely grinding pure quartz sand to a particle size of less than 15 μm ($d_{95}$, laser diffraction).

The pigment is prepared by mixing components A and B by known methods. The mixing ratio of component A to component B is preferably 5:95 to 95:5. The mixing ratio relates to proportions by weight.

The transparent, conductive pigments employed are preferably inorganic supports coated with doped tin oxide, for example mica flakes coated with antimony-doped tin oxide, quartz flour coated with antimony-doped tin oxide, mixtures of mica flakes coated with antimony-doped tin oxide and quartz flour coated with antimony-doped tin oxide.

Preferred transparent, electrically conductive pigments are mentioned below:

- natural or synthetic mica flakes coated with $(Sn,Sb)O_2$
- quartz flour, spherical, coated with $(Sn,Sb)O_2$
- quartz flour, spherical, coated with tungsten-doped tin oxide
- aluminium-oxide flakes, coated with tungsten- and phosphorus-doped tin oxide
- mixtures of (synthetic and/or natural) mica flakes and quartz flour, in each case coated with $(Sn,Sb)O_2$ Examples of very particularly preferred transparent, electrically conductive pigments are shown below:

- mica flakes, 10-60 μm, coated with $(Sn,Sb)O_2$
- mica flakes, 1-15 μm, coated with $TiO_2$ (1st layer)+$SiO_2$ (2nd layer)+$(Sn,Sb)O_2$ (3rd layer)
- quartz flour, 3 μm ($d_{50}$), spherical, coated with $(Sn,Sb)O_2$
- quartz flour, 3 μm ($d_{50}$), spherical, coated with tungsten-doped tin oxide
- quartz flour, 5 μm ($d_{50}$), spherical, coated with $(Sn,Sb)O_2$
- aluminium-oxide flakes, 5-25 μm, coated with tungsten- and phosphorus-doped tin oxide
- synthetic mica flakes, 10-50 μm, coated with $(Sn,Sb)O_2$
- synthetic $SiO_2$ spheres, amorphous, 0.5 μm ($d_{50}$), coated with $(Sn,Sb)O_2$
- mixtures of natural mica flakes, 10-60 μm, and quartz flour, 3 μm ($d_{50}$), coated with $(Sn,Sb)O_2$
- mixtures of synthetic mica flakes, 10-50 μm, and quartz flour, 3 μm ($d_{50}$), coated with $(Sn,Sb)O_2$ Examples of preferred pigments of this type are commercially available conductive pigments from Merck KGaA marketed under the name MINATEC®.

The care compositions according to the invention may comprise one or more, i.e. 2, 3 or 4, electrically conductive pigments. They preferably only comprise one electrically conductive pigment.

The transparent, electrically conductive pigments based on flake-form substrates or based on a mixture of flake-form substrate and spherical $SiO_2$ particles (crystalline and/or amorphous) facilitate care films for flooring having high conductivity and at the same time high transparency.

The concentration of the electrically conductive pigments in the care films depends on the composition of the care compositions and the requirements of the conductivity of the films and can in each case easily be determined by the person skilled in the art. In general, the pigment weight concentration in the care compositions is 10-60% by weight, preferably 15-40% by weight.

In this way, care films are obtained, irrespective of the very wide variety of bases, such as, for example, PVC, linoleum, laminate or rubber, which have low surface resistance values in the range less than $10^8$ ohm and have virtually no adverse effect on the color impression of the floorcoverings.

In addition, the films exhibit low soiling sensitivity for the common types of dirt and can readily be cleaned.

In contrast to the antistatic care films comprising salt-like antistatics, the electrical conductivity and antistatic efficacy are also guaranteed at low atmospheric humidity.

Other non-conductive surfaces can also be rendered conductive by treatment with the floor care compositions according to the invention.

The preferred care compositions include those which, in order to improve the mechanical resistance, comprise polymer compounds which are at least partially insoluble in water at neutral pH and which have a minimum film-formation temperature in the range 0-90° C. They are preferably polymers prepared from ethylenically unsaturated monomers. Examples of monomers of this type are styrene, acrylates or methacrylates of aliphatic alcohols having 1 to 8 C atoms, acrylonitrile, vinyl acetate, acrylic acid and methacrylic acid. Particular preference is given to poly(meth)acrylates comprising two or more of these monomers, which may optionally also comprise further monomers in a secondary amount. Very particularly preferred polymers comprise 1 to 30 parts by weight of carboxyl-containing monomers, 30-70 parts by weight of monomers which form homopolymers having glass transition temperatures of around 20° C., preferably esters of acrylic acid with $C_1$-$C_8$-alcohols and/or of methacrylic acid with $C_4$-$C_8$-alcohols, and 30-70 parts by weight of monomers which form homopolymers having glass transition temperatures above room temperature, preferably methacrylates of $C_1$-$C_3$-alcohols or styrene. If a plurality of different polymer compounds of the above-mentioned type are employed as a mixture in the polymer dispersion, the film-formation temperature determined for the mixture should be in the range from 0 to 70° C. The said film-formation temperatures relate to the plasticiser-free system, i.e. to the polymers without further additives. Examples of film-forming polymers of this type are the following commercial products, which are offered as dispersions: LICOMER® A 41 (Clariant), NEOCRYL® A 349 (Avecia), PRIMAL® B 527 (Rohm and Haas) or ECO STAR® (Ecolab).

Owing to the difficulty of removing polymers containing carboxylate groups, heavy-metal ions, for example zinc ions, which result in particularly resistant films on drying are frequently added. Commercially available polymer dispersions of this type are, for example, LODAN® Star (Ecolab), UBATOL® DW 3081 (Cray Valley), NEOCRYL® SR 267 (Avecia), PRIMAL® B 1604 (Rohm and Haas). Metal-crosslinked polymer floor coatings can also easily be removed again if required.

As a further type of film-forming polymer which can be used together with poly(meth)acrylates, mention must be made of polyurethanes, which are likewise commercially available for this purpose. Examples of suitable polyurethane dispersions are ALBERDINGK® U 210 W (Alberdingk Boley) and NEOREZ® 986 (Avecia).

The floor care compositions, in particular self-shining emulsions, preferably comprise the film-forming polymers in amounts of 10-35% by weight, in particular 10-20% by weight. These numerical data relate to the pure polymers. If the preparation of the dispersions already starts from dispersed polymers, as are frequently commercially available, correspondingly higher amounts of these dispersions should be used in the preparation of the care compositions. Polyurethanes can be represented in the care compositions in amounts up to 15% by weight, preferably 1-10% by weight.

Preferred polymer dispersions for care emulsions are acrylate dispersions, in particular those which comprise acrylates as film formers.

In a further embodiment, the care composition may also comprise plasticisers. The plasticisers serve for modification of the film consistency, where a distinction is made between temporary plasticisers and permanent plasticisers. The temporary plasticisers are generally volatile hydrophilic solvents which favour the coalescence of the polymer particles during film formation. Examples are ethylene glycol, diethylene glycol and glycol and polyglycol ethers. Their proportion in the care compositions is generally 0.5-15% by weight, preferably 0.5-10% by weight. Permanent plasticisers are liquids which are not volatile under standard conditions, meaning that the nature of the care film can be influenced specifically with their aid. Examples of plasticisers of this type are dibutyl phthalate, tributyl phosphate, tributoxyethyl phosphate and N-methylcaprolactam.

As further conventional additives, the care compositions generally comprise wetting agents and flow-control agents, which result in better wetting of the treated surface during application of the self-shining emulsion; this furthermore simplifies dilution of the care compositions with water, for example application to damp floors.

Use is made for this purpose of surfactants, in particular nonionic and anionic surfactants, for example ethoxylates of long-chain alcohols or alkylbenzenesulfonates and fatty alcohol sulfonates. The content of wetting aids and flow-control assistants is generally 0-5% by weight, preferably 0.1-2% by weight, based on the total weight of the self-shining emulsion. The wetting of the surface during application can also be improved with the aid of wetting resins. These resins are preferably styrene-maleate resins or modified polyacrylates. Their content in the care compositions is generally 0-5% by weight, preferably 0.1-2% by weight.

The care compositions according to the invention can be prepared by known mixing methods. In general, the starting material will be a pre-prepared polymer dispersion, as is commercially available, or a dispersion of the polymer will be prepared in water in a manner known per se. If the self-shining emulsion is also to comprise wax, this can firstly be converted separately into an emulsion in water, if necessary with addition of suitable wax emulsifiers, and added in this form to the polymer dispersion. The other constituents can then be introduced into this mixture with stirring. The pH of the care compositions is adjusted, if necessary, to the desired value in the pH range 5-9 with the aid of bases or acids. In order to avoid high shear forces, the electrically conductive pigments are preferably added last to the care compositions by stirring in order to obtain the flake form. In the simplest case, the conductive pigments are added to a commercially available care-composition dispersion.

The care compositions generally comprise at least one further ingredient selected from the group comprising anionic surfactants, nonionic surfactants, acidifiers, alkalising agents, antibacterial substances, antimicrobial active compounds, antioxidants, dyes, fungicides, preservatives, solvents, wetting agents, fragrances, UV stabilisers, flow-control agents, viscosity regulators, waxes or plasticisers.

Suitable commercially available care compositions for use of the transparent, electrically conductive pigments are, for example, floor care compositions selected from the group: Megla-Pol (Tana), LODAN® Star (Ecolab), Wokamer (Kahl), NeoCryl® SR-270 (DSM), Permanol® N95 (Dick Peters), LODAN® Star (Ecolab), Super Lastic Metallic (Budich GmbH), Trigomat (Budich GmbH) and Hospital Polymer (Budich GmbH).

The formulation of the care composition according to the invention preferably depends on the requirements of the application. Compositions according to the invention can be in solid, semisolid, liquid, disperse, emulsified, suspended, aerosol or gelatinous form. The term liquid in the sense of the invention also includes any dispersions of solids in liquids. Compositions according to the invention can also be in the form of pastes. Suitable polymer pastes are both solvent-containing and aqueous pastes. Pastes of this type usually comprise relatively high proportions of waxes, for example carnauba wax or montan wax.

The care compositions, in particular the self-shining emulsion, are generally used in undiluted form. The care compositions are generally applied to the surface or evenly distributed thereon in the desired amount with the aid of a soft article, for example using a wiping cloth or sponge. After evaporation of the solvent, generally water, a care film with uniform sheen remains behind.

In the case of liquid care compositions, for example, the application can also be carried out using so-called wet wipes, i.e. moist cloths pre-fabricated for the user and preferably packed individually. Such wet wipes, which may advantageously also comprise preservatives, are then impregnated or coated with the care composition according to the invention.

If the care compositions according to the invention are in liquid form, the application can also be carried out using spray equipment. This spray equipment contains the care composition (in liquid, suspension or powder form) according to the invention in a tank. The tank contents may be under the pressure of a propellant (compressed-gas cans, compressed-gas packs, aerosol packs) or a mechanically operated pump spray can be used. The tank has a withdrawal device, preferably in the form of valves, which enable the contents to be withdrawn as mist, smoke, foam, powder, paste or liquid jet. Suitable tanks for the spray equipment are, in particular, cylindrical vessels made from metal (aluminium, tinplate, capacity preferably <1000 ml), safety or non-shattering glass or plastic (capacity preferably <220 ml) or shattering glass or plastic (capacity preferably <150 ml).

The thickness of the care film depends on the requirements. The layer thickness of the dry layer is typically 3-20 μm, preferably 5-10 μm. The care films are applied by single or repeated application of the care composition using a suitable device. Thicker layers can be obtained by repeated application. The care composition can be applied most simply using a mop.

In this way, care films are obtained, irrespective of the very wide variety of bases, such as, for example, PVC, linoleum, laminate or rubber, which have low surface resistance values in the range less than $10^8$ ohm and have virtually no adverse effect on the color impression of the floorcoverings.

In addition, the conductive coatings according to the invention may also be applied to conventional floorcoverings without an antistatic or static-dissipation finish. Floorcoverings of this type thus also attain good antistatic properties, which may, if desired, be improved further by attachment of suitable earthing of the floorcovering.

The care composition according to the invention can be employed universally as cleaning material for all hard surfaces in the household and trade, in particular for flooring which can be wiped in wet or damp form. In general, the products are neutral or weakly alkaline or weakly acidic, in particular liquid products.

Other non-conductive surfaces can also be provided with a conductive finish by application of the coatings according to the invention.

The care films can also be removed again after wear or excessive soiling using suitable assistants and cleaning compositions, for example by means of alkaline cleaning materials comprising amines, carbonates, phosphates or hydroxides or by means of solvent-containing cleaning products.

The floorcovering can subsequently be re-coated with a new conductive care film without the appearance and high requirements of the electrical properties being impaired. The pigmented care and cleaning composition according to the invention is particularly suitable for the maintenance and cleaning of hard floors with coverings comprising ceramic, stone, wood, linoleum, PVC, rubber, cork, laminate, crosslinked epoxy resins, polyurethanes, acrylates or melamine resins.

The care composition pigmented in accordance with the invention is furthermore distinguished by the fact that it provides protection against moisture and wear and produces a surface sheen. It demonstrably reduces the uptake of dirt and improves the slip resistance of the floors without losing its antistatic properties.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and, all parts and percentages are by weight, unless otherwise indicated.

USE EXAMPLES

Example 1

Preparation of Conductive Self-Shining, Pigment-Based Dispersions

The conductive pigments a) MINATEC®51 (Merck KGaA)
[mica flakes having a particle size of 10-60 μm coated with $(Sn,Sb)O_2$]

b) MINATEC®60 (Merck KGaA)
[mica flakes having a particle size of 10-60 μm and quartz flour (3 μm, $d_{50}$) coated with $SiO_2$+$(Sn,Sb)O_2$]

c) aluminium oxide flakes having a particle size of 5-25 μm coated with tungsten- and phosphorus-doped tin oxide ("TPdTO")

are added in a concentration of 6% to conventional self-shining dispersions (electrically insulating per se) and subsequently dispersed for 20 min using a propeller stirrer (800 revolutions $min^{-1}$).

Two commercially available self-shining dispersions (SSDs):

1. LODAN® Star, Ecolab, metal-crosslinked SSD (SSD-mc), solids content about 26% by weight,
2. ECO STAR®, Ecolab, metal salt-free dispersion, solids content about 20% by weight, each based on polyacrylate, metal-crosslinked (SSD-mc) or metal salt-free (SSD-msf), are used for this purpose.

The following conductive self-shining dispersions are obtained:

SSD 1 (SSD-mc): LODAN® Star comprising 6% by weight of MINATEC®60.

SSD 2 (SSD-mc): LODAN® Star comprising 6% by weight of MINATEC®51.

SSD 3 (SSD-mc): LODAN® Star comprising 3% by weight of MINATEC®51 and 3% by weight of MINATEC®60.

SSD 4 (SSD-mc): LODAN® Star comprising 6% by weight of TPdTO.

The care films produced using self-shining dispersions SSD 1 to 4 comprise 20% by weight of conductive pigments in the dry film.

SSD 5 (SSD-msf): ECO STAR® comprising 6% by weight of MINATEC®60.

SSD 6 (SSD-msf): ECO STAR® comprising 6% by weight of MINATEC®51.

SSD 7 (SSD-msf): ECO STAR® comprising 3% by weight of MINATEC®51 and 3% by weight of MINATEC®60.

SSD 8 (SSD-msf): ECO STAR® comprising 6% by weight of TPdTO.

SSD 9 (SSD-msf): Lodan® Star comprising 10% by weight of MINATEC®60.

BRIEF DESCRIPTION OF THE DRAWINGS

FIGS. 1-4 represent physical characteristics of films produced with the composition of the invention.

FIG. 5 provides a comparative showing of the soiling behavior and cleaning intensity for films produced with and without the compositions of the claimed invention.

The care films produced using self-shining dispersions SSD 5 to 8 comprise 24% by weight of conductive pigments in the dry film.

In contrast to the case for the commercially available antistatic care films (ion conductors), the electrical conductivity and antistatic efficacy in a self-shining dispersion modified with conductive pigments (electron conductor) are independent of the atmospheric humidity (FIG. 1). A conventional self-shining dispersion which is not suitable for floorcoverings in electrically sensitive areas exhibits a layer structure on the surface of the floorcovering and thus an electrically insulating action.

Determination of the Volume Resistance Values of the Conductive Care Films

Self-shining dispersions 1-8 in accordance with Example 1 are applied to an electrically conductive PVC floorcovering in a wet-film thickness of 25 μm, dried and conditioned at 25% RH. The volume resistance values of the samples are measured after 24 hours. The care films obtained in this way have volume resistance values between $1.3\times10^6\Omega$ and $4.2\times10^7\Omega$ (Table 1).

TABLE 1

Volume resistance values

| SSD | Pigment | PMC | Volume resistance |
|---|---|---|---|
| SSD 1 | MINATEC ® 60 | 20.0% | $3.33\times10^6\ \Omega$ |
| SSD 5 | MINATEC ® 60 | 24.0% | $1.33\times10^6\ \Omega$ |
| SSD 2 | MINATEC ® 51 | 20.0% | $1.67\times10^6\ \Omega$ |
| SSD 6 | MINATEC ® 51 | 24.0% | $1.33\times10^6\ \Omega$ |
| SSD 3 | Mixture | 20.0% | $2.67\times10^6\ \Omega$ |
| SSD 7 | Mixture | 24.0% | $1.67\times10^6\ \Omega$ |
| SSD 4 | TPdTO | 20.0% | $4.17\times10^7\ \Omega$ |
| SSD 8 | TPdTO | 24.0% | $2.33\times10^6\ \Omega$ |

The volume resistance is measured by means of a high-ohm measuring instrument (model HM 307 D, Fetronic GmbH, Langenfeld, with corresponding measurement electrodes) at an atmospheric humidity (RH) of 25%. The measurements are carried out in accordance with EN 61340-1-4 on conductive PVC floorcoverings with correspondingly modified self-shining dispersion in accordance with Example 1.

Color and Sheen Measurements

The color and sheen measurements are carried out by means of a spherical spectrophotometer (spectro-guide, BYK-Gardner GmbH). The color values are recorded in accordance with DIN 5033 Part 3 via the overall color difference ΔE in the CIELAB color system. L* here describes the luminance, a* describes the red/green value and b* describes the yellow/blue value. An L* value of "100" is ideal white and an L* value of "0" is ideal black. The measurement is carried out with illuminant D65 and an angle of the perpendicular observer of 10° to the gloss component. The gloss of the floorcoverings is measured in accordance with DIN 67530 or EN ISO 2813 at an angle of incidence of 60°. 10 measurements are carried out per sample. The measurement points are selected randomly over the entire measurement area.

No luminance differences are observed due to the addition of the conductive pigments to the self-shining dispersions in accordance with the information in Example 1 compared with the conventional care film without addition of a pigment on rubber (FIG. 2).

FIG. 3 shows the gloss values of the conventional self-shining dispersion and the self-shining dispersion modified with conductive pigments.

Soiling Behavior and Cleaning Intensity

In order to check the soiling behavior and cleaning intensity, suitable practice-relevant soiling methods are developed for the application of, for example, Standard Leverkusen Dirt and corresponding soiling monitors are produced. The dirt types are applied to the floorcovering in defined amounts and characterised by measurement of the luminance. Standard Leverkusen Dirt 40 (wfk Testgewebe GmbH) is a pigment-containing, strongly adherent mixed dirt with nonpolar, oil-like components comprising, inter alia, aluminium oxides and silicon oxides, rubber black, yellow iron oxide, black iron oxide (luminance L*=40 in accordance with DIN 5033).

The thoroughly cleaned floorcoverings without care film soil to a greater extent with Standard Leverkusen Dirt 40 than do the floorcoverings with a modified care film (SSD 9 from Example 1 (FIG. 5). In addition, the cleaning intensity is increased by the application of the modified care film.

The Standard Leverkusen Dirt (LD 40) is applied by means of an abrasion tester and a microfibre cloth (m=300 g, $p_A\approx0.1$ N $cm^{-2}$, up to 5 double strokes). The soiled floorcoverings are cleaned by means of a 903PG wet abrasion scrub tester (Sheen Instruments) with up to 5 double strokes using cut-to-size 10.6 cm×3.6 cm household cloths (nonwoven PES/Cel 30/70) at a pressure of 0.11 N $cm^{-2}$ and a feed rate of 33.3 cm/s. The cleaning materials are employed in the recommended use concentration (0.3 ml/$cm^2$ of cloth area). The cloth used is wrung out using laboratory pad mangle setting 4.

The entire disciosure[s] of all applications, patents and publications, cited herein and of corresponding German application No. DE 10 2010 012 197.5, filed Mar. 19, 2010 is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A composition comprising one or more transparent electrically conductive pigments which comprise a flake-form substrate, and a dispersion or emulsion polymer film-forming component, and a surfactant which provides a cleaning action, said composition being suitable for cleaning and protection of electrostatic discharge flooring.

2. The composition according to claim 1, wherein the pigments comprise mixtures of spherical particles with flake-form substrates.

3. The composition according to claim 1, wherein the flake-form substrate is natural or synthetic mica flakes, glass flakes, $SiO_2$ flakes, $TiO_2$ flakes, $Al_2O_3$ flakes, sericite, kaolin or talc.

4. The composition according to claim 1, wherein the conductive pigments comprise a doped metal oxide or a doped metal-oxide mixture as conductive layer.

5. The composition according to claim 4, wherein the conductive layer is antimony-doped tin oxide, antimony- and tellurium-doped tin oxide, tin-doped indium oxide, aluminium-doped zinc oxide, fluorine-doped tin oxide, tungsten-doped tin oxide, tungsten- and phosphorus-doped tin oxide or indium-doped zinc stannate.

6. The composition according to claim 1, wherein the conductive pigments comprise a flake-form substrate which is coated with one or more non-conductive metal-oxide layers.

7. The composition according to claim 1, comprising 15-60% by weight of conductive pigments, based on the total composition.

8. The composition according to claim 1, further comprising at least one anionic surfactant, nonionic surfactant, acidifier, alkalizing agent, antibacterial substance, antimicrobial active compound, antioxidant, dye, fungicide, preservative, solvent, wetting agent, fragrance, UV stabilizer, flow-control agent, viscosity regulator, wax or plasticiser.

9. A composition according to claim 1, wherein the flake form substrate has a thickness of between 0.02 and 5 μm and a size in the other two dimensions between 1 and 250 nm.

10. A process for the preparation of the composition according to claim 1, comprising adding electrically conductive pigments which comprise a flake-form substrate to a dispersion or emulsion polymer film-forming composition comprising a surfactant which provides a cleaning action.

11. A method for the maintenance and cleaning of floors or work surfaces with coverings comprising ceramic, stone, wood, linoleum, PVC, rubber, cork, laminate, crosslinked epoxy resins, polyurethanes, acrylates or melamine resins, comprising applying to said coverings a composition according to claim 1.

12. A method for the cleaning and care of electrostatic discharge work surfaces or floor coverings, comprising applying to said surfaces or coverings a composition according to claim 1.

13. A method for the preparation of a conductive surface on a non-conductive material, comprising applying to said material a composition according to claim 1, whereby a film of said composition is produced on said material and forms said conductive surface.

* * * * *